US005339149A

United States Patent [19]

Lindblad et al.

[11] Patent Number: 5,339,149

[45] Date of Patent: Aug. 16, 1994

[54] NON-STICK SPOTS BLADE

[75] Inventors: Nero R. Lindblad, Ontario; Douglas A. Lundy, Webster; Kip L. Jugle, Holcomb, all of N.Y.

[73] Assignee: Xerox Corporation, Stamford, Conn.

[21] Appl. No.: 110,258

[22] Filed: Aug. 23, 1993

[51] Int. Cl.[5] ..... G03G 21/00

[52] U.S. Cl. ..... 355/297; 355/296; 355/299

[58] Field of Search ..... 355/296, 297, 299, 301; 15/93.1, 97.1

[56] References Cited

U.S. PATENT DOCUMENTS

| | | | |
|---|---|---|---|
| 4,669,864 | 6/1987 | Shoji et al. . | |
| 4,974,030 | 11/1990 | Tokunaga et al. | 355/296 |
| 4,989,047 | 1/1991 | Jugle et al. | 355/297 |
| 5,061,966 | 10/1991 | Haneda et al. | 355/297 |
| 5,111,251 | 5/1992 | Uno et al. | 355/297 |
| 5,126,798 | 6/1992 | Leroy et al. | 355/297 |
| 5,138,395 | 8/1992 | Lindblad et al. | 355/299 |
| 5,148,227 | 9/1992 | Senba et al. | 355/296 |
| 5,153,657 | 10/1992 | Yu et al. | 355/299 |
| 5,157,098 | 10/1992 | Lindblad et al. | 355/299 X |
| 5,175,591 | 12/1992 | Dunn et al. | 355/297 |

FOREIGN PATENT DOCUMENTS

| | | | |
|---|---|---|---|
| 3232677 | 3/1983 | Fed. Rep. of Germany | 355/299 |
| 0089884 | 4/1988 | Japan | 355/299 |
| 0129381 | 6/1988 | Japan | 355/299 |
| 0309986 | 12/1988 | Japan | 355/299 |
| 0314280 | 12/1989 | Japan | 355/299 |

*Primary Examiner*—A. T. Grimley
*Assistant Examiner*—Sandra L. Brasé
*Attorney, Agent, or Firm*—T. Fair

[57] ABSTRACT

A cleaning apparatus having a spots cleaning blade to remove residual agglomerations of particles from the imaging surface. The spots cleaning blade is made from a material that has a low coefficient of friction, low resilience and higher hardness than a standard spots blade. These properties enable the spots cleaning blade to provide a continuous slidable contact with the imaging surface to remove residual particles therefrom.

10 Claims, 3 Drawing Sheets

NON-STICK SPOTS BLADE

BACKGROUND OF THE INVENTION

This invention relates generally to an electrostatographic printer and copier, and more particularly, concerns a cleaning apparatus for removal of residual particles and agglomerates from the imaging surface.

In an electrophotographic application such as xerography, a charge retentive surface is electrostatically charged, and exposed to a light pattern of an original image to be reproduced to selectively discharge the surface in accordance therewith. The resulting pattern of charged and discharged areas on that surface from an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices, where a charge is imagewise deposited on a charge retentive substrate, operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive or insulative fiber bristles. While the bristles are soft they are sufficiently firm to remove residual toner particles from the charge retentive surface. A voltage is applied to the fibers to enhance removal of toner from the charge retentive surface.

Not all toner and debris is removed from the surface by the brush cleaner. For reasons that are unclear, toner particles agglomerate with themselves and with certain types of debris to form a spot-wise deposition that can eventually strongly adhere to the charge retentive surface. These spots range from 50 micrometers to greater than 400 micrometers in diameter and 5 to 25 micrometers in thickness, but typically are about 200 micrometers in diameter and 5 to 15 micrometers in thickness. The agglomerates range in material compositions from nothing but toner to a broad assortment of plastics and debris from paper. The spots cause a copy quality defect showing up as a black spot on a background area of the copy which is the same size as the spot on the photoreceptor. The spot on the copy varies slightly with the exact machine operating conditions, but cannot be deleted by controlling the machine process controls.

Attempts to eliminate the agglomerate spotting by controlling of extraneous debris have been found difficult if not impossible to implement. Additionally, there was no way to eliminate the formation of agglomerates that the toner formed itself. However, in studying the formation of these spots, it was noted that the spots appeared instantaneously on the charge retentive surface, i.e., the spots were not the result of a continuing nucleation process. It was subsequently noted that newer deposited spots were more weakly adhered to the surface than older spots.

Several copier products commonly use a urethane blade material (e.g. 107-5, supplied by Acushnet) for a spots blade. The spots blade is positioned, after the cleaning station, to remove agglomerations and debris from the photoreceptor. The use of a spots blade as a secondary cleaner for these products has been shown to be very effective in removing debris that can cause a spot defect on the copy. However, many of the spots blades presently used have the disadvantage of high friction between the blade and the photoreceptor. This causes the spots blade to intermittently stick to the photoreceptor surface creating a type of bouncing or skipping action of the spots blade as it rides on the photoreceptor. This bouncing or skipping action can cause copy quality defects. Furthermore, spots blades that exhibit high friction can foldover when placed in pressure contact with the photoreceptor. When failure due to foldover occurs, the blade must be replaced.

The following disclosures may be relevant to various aspects of the present invention and may be briefly summarized as follows:

U.S. Pat. No. 4,989,047 to Jugle et al. discloses a cleaning apparatus for an electrophotographic printer that reduces agglomeration-caused spotting on the imaging surface. A secondary cleaning member, characterized as a thin scraper blade, is arranged at a low angle of attack, with respect to the imaging surface, to allow a maximum shearing force to be applied by the blade to the agglomerates for removal thereof.

U.S. Pat. No. 4,669,864 to Shoji et al. discloses a cleaning device arranged on the outer periphery of an image retainer brought into and out of abutment against the image retainer. The cleaning device comprises a first cleaning member, a blade, and a second cleaning member, a brush, arranged downstream of the first cleaning member in the moving direction of the surface of the image retainer.

SUMMARY OF INVENTION

Briefly stated, and in accordance with one aspect of the present invention, there is provided an apparatus for cleaning the residual materials from an imaging surface, comprising a housing and a holder attached to the housing. A primary cleaner, at least partially enclosed in the housing and a second cleaner, located upstream from the primary cleaner. The second cleaner having one end coupled to the holder and a free end opposite thereto. The free end being in pressure contact with the imaging surface with minimal coefficient of friction therebetween. The free end having continuous slidable contact on the imaging surface.

Pursuant to another aspect of the present invention, there is provided a cleaning blade in pressure contact with a surface and being adapted to remove particles therefrom, comprising a blade body including an elastomeric material having a coefficient of friction less than three and a durometer ranging from about 80 Shore A to about 90 Shore A. The material having a resiliency ranging from about 20% to about 25% rebound.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
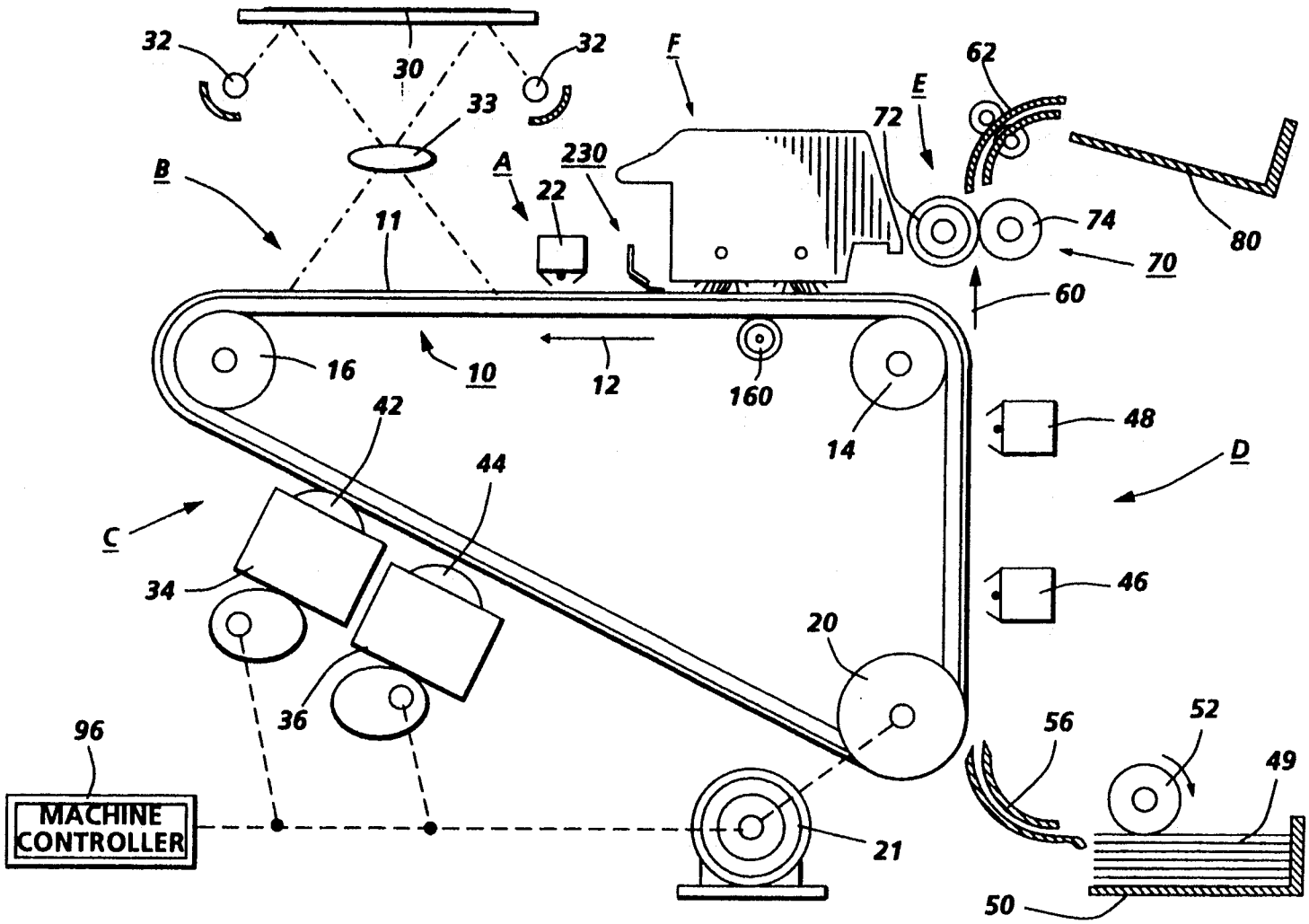
FIG. 3 is a schematic elevational view of a printing apparatus.

For a general understanding of an electrophotographic printer or copier in which the present invention may be incorporated, reference is made to FIG. 3 which depicts schematically the various components thereof. Hereinafter, like reference numerals will be employed throughout to designate identical elements. Although the spots blade of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 3 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F or stored for disposal. The spots blade cleaning apparatus 230 is located upstream, in the direction of movement of the photoreceptor, from the cleaning station F.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

Figure 1:
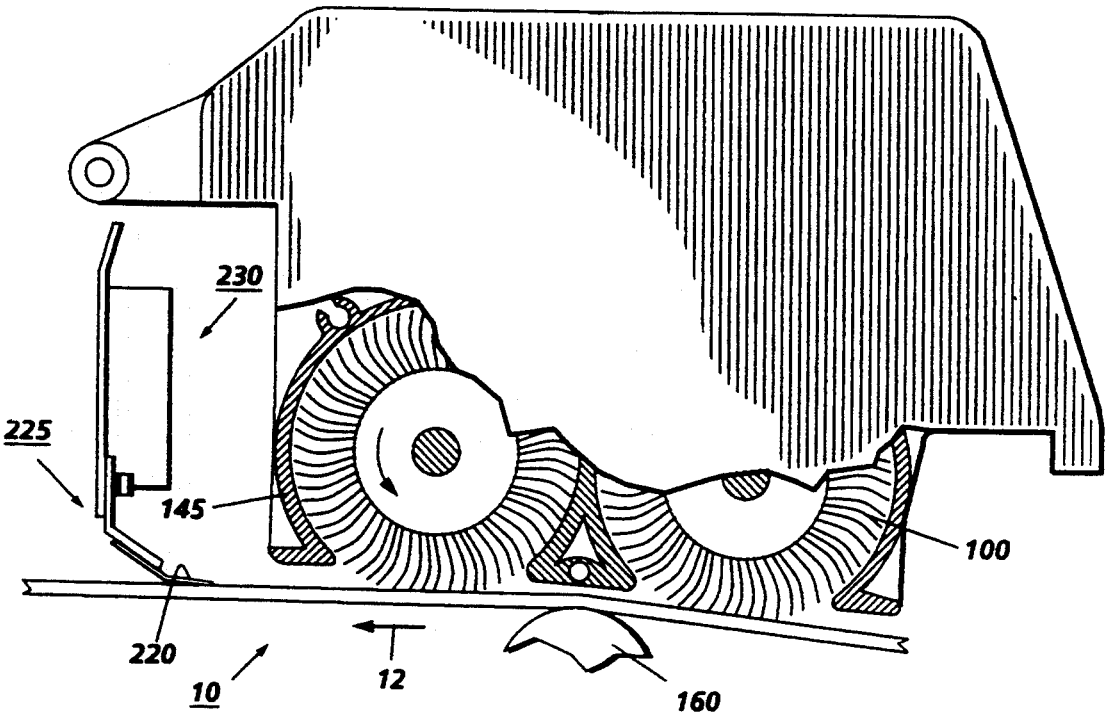
FIG. 1 is a schematic view of the spots blade located upstream from the primary cleaner.
Figure 2:
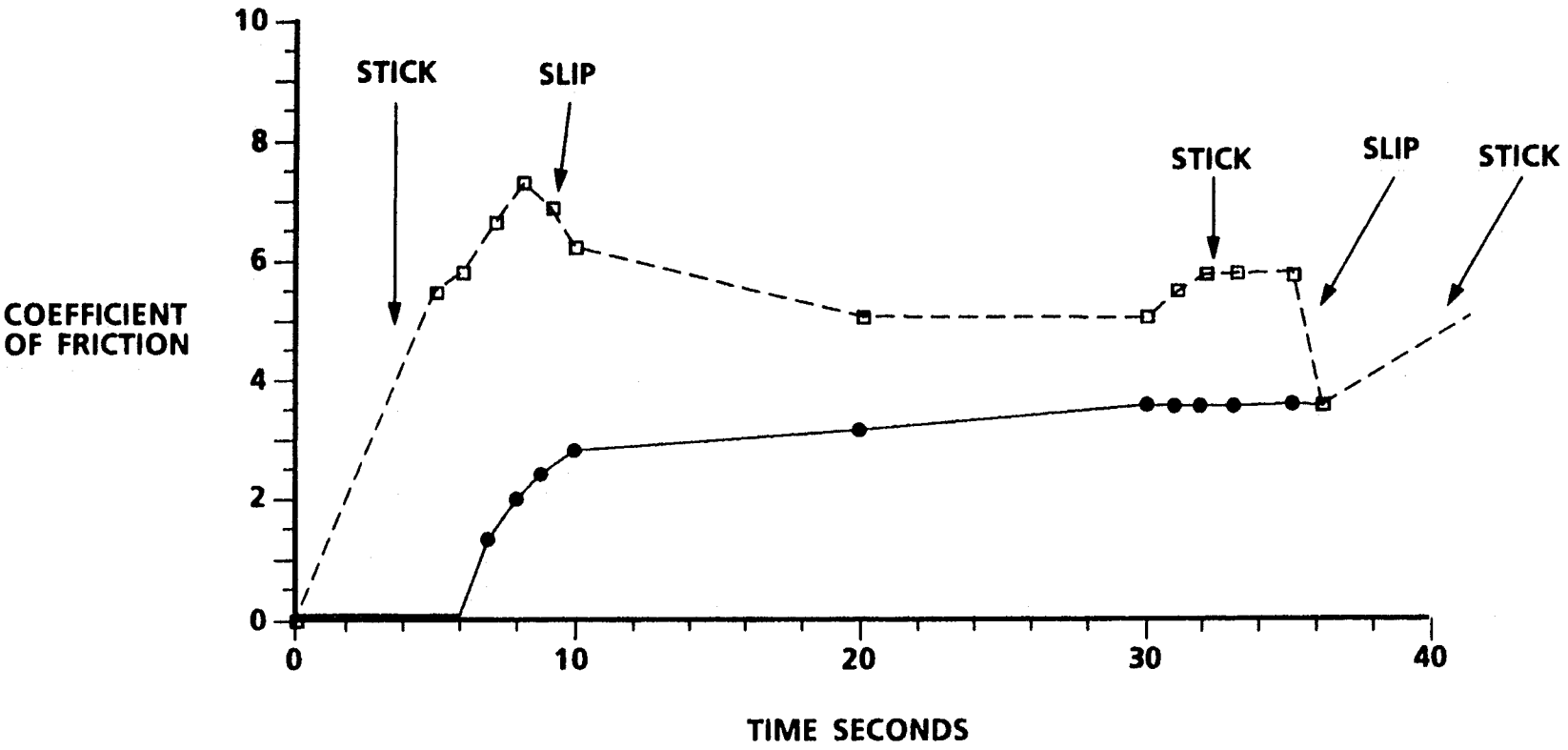
FIG. 2 is a frictional trace graph comparing two spots blade materials, 107-5 and E490.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 and 2 where the showings are for the purpose of illustrating a preferred embodiment of the invention and not for limiting the same cleaning apparatus incorporating the elements.

Reference is now made to FIG. 1, which is a frontal elevational view of the cleaning system and the spots blade assembly 230. The spots blade assembly 230 comprises a holder 225 and a spots disturber blade 220. The spots blade assembly 230 is located upstream, in the direction of movement 12 of the photoreceptor 10, to disturb residual particles not removed by the primary cleaner brushes 100. This spots disturber blade 220 is similar to that used in the Xerox 5090 copier. The spots blade disturber 220 is normally in the doctoring mode to allow a build up of residual particles in front of the spots blade 220 (i.e. between the brush cleaner housing 145 and the spots blade 220). This build up of residual particles is removed by the air flow of the vacuum. The spots blade material of the present invention combines the mechanical properties of low friction, low resilience and high hardness to provide a continuous slidable contact between the spots blade 220 and the photoreceptor surface. This continuous slidable contact is a result of the mechanical properties and not a lubricant introduced to the cleaning operation.

The present invention reveals the combination of mechanical properties that are ideal for a spots blade, and a material that supplies these mechanical properties. The ideal mechanical properties of a spots blade are low friction (adhesion), low resiliency and high hardness. The urethane material (i.e. polyester) of the present invention has a low coefficient of friction and a high hardness which enables it to avoid the tucking characteristic of the urethane spots blade material (i.e. Acushnet 107-5) commonly used, that causes blade failures. Blade tucking normally has a low rate of incidence when the photoreceptor surface is dirty (i.e. when the toner density on the photoreceptor surface is high). However, a clean photoreceptor surface causes high friction to occur between the blade and the photoreceptor surface making blade start-up on the clean surface difficult. This high friction also causes the blade to bounce intermittently when the machine is making copies. Thus, a low functional coefficient ($\mu<3$) indicates that the adhesion of urethane to the clean surface is very low. When it is this low ($\mu<3$) the blade will not stick or foldover at start-up or bouncing in the running mode. The combination of the above mentioned mechanical properties resolve this common spots blade problem.

A urethane material that contains the mechanical properties of the present invention is E490 which is available from Acushnet. In lab testing of the E490 material, the E490 material demonstrated lower friction, lower resilience and higher hardness than the 107-5 blade material commonly used. These mechanical properties are the desirable characteristics for a spots blade to alleviate the start-up and the blade bounce problems that occur with the 107-5 blade material.

First, there is a much lower frictional coefficient in E490 than in the 107-5 blade material. The coefficient of friction for E490 (averages about 3 for a clean blade on a clean photoreceptor surface) is 50% less than 107-5 (i.e. the frictional coefficient averages about 6). (See the frictional trace graph of these two materials in FIG. 2). The frictional force is low enough to allow the E490 material to contact the photoreceptor at start-up without lubrication. And, also reduce photoreceptor abrasion by the spots blade.

The following is a description of the test data comparing the frictional characteristics of 107-5 and E490 shown in FIG. 2. The adhesion (friction) of clean 107-5 blade material and clean E490 blade material was measured and video taped as a function of time on a slowly rotating, clean glass cylinder. The blade wear patterns produced on this fixture are similar to the blade wear found in copiers. The initial slope of the curve is indicative of the adhesion between the blade and the surface. In this part of the trace, the 107-5 blade is tucking severely. When the initial adhesion is overcome by the moving of the imaging surface, the blade untucks momentarily, and then sticks again to the glass. This sticking and releasing of the blade is commonly referred to as "stick-slip" motion. The sticking part is the adhesion and the slipping part is the blade untucking. There is a marked difference between these two traces. The 107-5 material immediately adheres to the moving glass surface for 8 seconds before it releases, and then starts to adhere again. The initial peak frictional coefficient for 107-5 was 7.4. The "stick-slip" behavior destroyed the blade edge after three minutes.

The E490 slides on the glass surface before adhesion develops. The peak frictional coefficient for E490 was 3.0 after 10 seconds. The E490 did not exhibit "stick-slip" motion or blade wear after four minutes.

Secondly, the resiliency is 50% lower than the 107-5 material. This reduces blade bounce (i.e. blade bounce is the intermittent sticking of the blade to the photoreceptor resulting from friction such that the blade doesn't have a continuous sliding motion against the photoreceptor but more of a stop and start sliding motion). Prior testing has shown that developer at the cleaning edge will damage the blade edge and scratch the photoreceptor surface when the blade bounces over the seam. The developer accumulates under the blade during the "bounce" and the ones that become lodged under the blade can scratch the photoreceptor and cause blade wear. Thus, the resiliency of the blade can be associated with a mechanical property that enhances scratching of the photoreceptor and a cause of blade wear. Thus, the resiliency of the material should be low to reduce the blade bounce.

Resiliency is another property that is different between these two urethanes. The percent rebound at room temperature is 25% for E490, and 50% for 107-5. Thus, there is a factor of two difference in resiliency between these urethane materials. This property has to be designed into the urethane because high durometer can be very resilient. The resiliency should be as low as possible to reduce blade bounce.

Finally, the E490 material has a higher hardness than the 107-5 material. The higher durometer of the E490 material makes the blade stiffer than the 107-5 material, eliminates blade tuck, and reduces blade "bounce". In the 107-5 blade material, the durometer value is about 70 shore A, whereas the durometer of E490 is about 90 Shore A (i.e. 85±5). This difference makes the latter material significantly stiffer and harder than the 107-5. Higher durometer urethanes generally exhibit much lower frictional properties, and it is the high hardness and lower friction that reduces the adhesion of the blade to the photoreceptor. Thereby, eliminating the foldover start-up problem and intermittent blade bounce when the machine is making copies.

Another advantage of the mechanical properties of the present invention in the material E490 is defined by the following example. A spots blade of 107-5 material, used in a doctoring mode (i.e. the blade has a chiseling action), is positioned with a low blade force (i.e. about 8 grams–12 grams) and a low working angle of less than 5°. Under these set points, the 107-5 cleaning blade edge should maintain an untucked position as the blade edge moves across the imaging surface of the photoreceptor. However, due to the flexibility of the photoreceptor and the blade "bounce" caused by the seam of the photoreceptor, the blade force and working angle can increase and cause the blade to tuck and this limits the life of the blade. A material having the mechanical properties (i.e. low friction, low resiliency, and high hardness) of the present invention, such as E490 by Acushnet, will maintain the blade force and working angle setpoints and eliminate the blade tucking, "bounce", and increase blade life. Also, the hardness of the blade of the present invention makes it unnecessary to have a 90 degree cleaning tip angle.

An alternative embodiment is to use a beveled edge for the blade tip angle 60°–80° to chip spots and other debris off of the photoreceptor. However, for this embodiment a urethane material that is hard enough to withstand tucking at the tip is required.

In recapitulation, the present invention is a blade material having the combined mechanical properties of low friction, low resiliency and high hardness. This type of blade material provides a spots blade that avoids the problem of "stick-slip" between the cleaning edge of the blade and the imaging surface. A material that provides this combination of mechanical properties is E490 available from Acushnet. This material provides a continuous sliding motion across the surface being cleaned thus, eliminating tucking and bounce and increasing the blade life.

It is, therefore, apparent that there has been provided in accordance with the present invention, a combination of mechanical properties in a blade material that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning the residual materials from an imaging surface, comprising:

a housing;

a holder attached to said housing;

a primary cleaner, at least partially enclosed in said housing; and a resilient blade, having a resiliency ranging from about 20% to about 25%, said blade being located upstream from said primary cleaner, said blade having one end coupled to said holder and a free end opposite thereto, said free end being in pressure contact with the imaging surface having a minimal coefficient of friction therebetween enabling said free end to be in continuous slidable contact with said imaging surface.

2. An apparatus as recited in claim 1, wherein said primary cleaner comprises a brush.

3. An apparatus as recited in claim 2, wherein said blade comprises an elastomeric material.

4. An apparatus as recited in claim 3, wherein said elastomeric material is selected from the group of materials consisting of polyester urethanes.

5. An apparatus as recited in claim 4, wherein said blade has a durometer value ranging from about 80 Shore A to about 90 Shore A.

6. An apparatus as recited in claim 4, wherein said material comprises a frictional peak of less than three over a ten second interval.

7. An apparatus for cleaning the residual materials from an imaging surface, comprising:

a housing;

a holder attached to said housing;

a brush cleaner, at least partially enclosed in said housing; and a blade cleaner, having a resiliency ranging from about 20% to about 25%, located upstream, in the direction of movement of the photoreceptor, from said brush cleaner, said blade cleaner having one end coupled to said holder and a free end opposite thereto, said free end being in pressure contact with the imaging surface having a minimal coefficient of friction therebetween enabling said free end to be in continuous slidable contact with said imaging surface, said blade cleaner being an elastomeric material selected from the group of materials consisting of polyester urethanes.

8. A cleaning blade in pressure contact with a surface and being adapted to remove particles therefrom, comprising a blade body including an elastomeric material having a coefficient of friction less than three and a durometer ranging from about 80 Shore A to about 90 Shore A, with a resiliency ranging from about 20% to about 25%.

9. A cleaning blade as recited in claim 8, wherein said elastomeric material is selected from the group of materials consisting of polyester urethanes.

10. An apparatus as recited in claim 8, wherein the coefficient of friction is measured over a ten second interval.

* * * * *